United States Patent [19]

Loper et al.

[11] Patent Number: 4,602,765

[45] Date of Patent: Jul. 29, 1986

[54] FENCING ASSEMBLY AND PROCESS

[76] Inventors: Karl J. Loper, 3170 Barnes Rd., Millington, Mich. 48746; Archie Wilson, 1470 Pebblecreek Rd., Metamora, both of Mich. 48455

[21] Appl. No.: 603,167

[22] Filed: Apr. 23, 1984

[51] Int. Cl.[4] ..... E04H 17/14
[52] U.S. Cl. ..... 256/19; 256/66
[58] Field of Search ..... 256/19, 66, 59

[56] References Cited

U.S. PATENT DOCUMENTS

| | | | |
|---|---|---|---|
| 3,554,494 | 1/1971 | Bee | 256/19 |
| 3,957,250 | 5/1976 | Murphy | 256/19 |
| 4,181,764 | 1/1980 | Totten | 256/19 X |
| 4,324,388 | 4/1982 | Klaser | 256/19 |

*Primary Examiner*—Andrew V. Kundrat

[57] ABSTRACT

A fencing assembly including posts fabricated from extruded plastic tubes and filled with particulate matter and binder to form a core of a predetermined density. The posts are capped at the top and bottom to seal the interior against moisture and weather. Rails are constructed in a like manner to the posts.

3 Claims, 4 Drawing Figures

FENCING ASSEMBLY AND PROCESS

BACKGROUND OF THE INVENTION

This invention relates to the field of fencing and to an assembly and to the process of fabricating the assembly and its parts.

A major problem encounterd in constructing fences is finding material that resists weathering and rotting. When the fence is used to enclose animals, particularly horses, it is essential that the fence be fabricated from a material that the horses will not chew on and eat. The fences constructed in accordance with the invention meet this requirement.

A further problem has arisen from increased costs attached to the use of lumber in fencing. The process of the present invention makes possible the use of waste particulate materials such as sawdust, wood chips and even common trash with a chemical binder added to adhere the particles together and to a plastic tube that forms the external part of the post.

Prior art fencing materials are known in which tubes are used and in which the filler is of concrete and forms a part of the foundation. Such a fencing assembly is shown and described in U.S. Pat. No. 4,364,546 issued on Dec. 21, 1982 to Lyman et al. for "Modular Fencing Assembly".

Tubular posts of various configurations are known in the prior art. One of these is shown and described in U.S. Pat. No. 4,324,388 issued on Apr. 13, 1982 to William A. Klasser for "Fence Structure".

It is also known to use lumber as the core and to sheath it with a protective abrasion resistant coating. This type of device is shown and described in U.S. Pat. No. 4,181,764 issued on Jan. 1, 1980 to Clyde D. Totten for "Weather Resistant Structure and Method of Making".

A still futher type of fencing in which core members of wood or steel are slid into channels of plastic extrusions are known and shown in U.S. Pat. No. 3,554,494 issued on Jan. 12, 1971 to F. Ree for "Building Components".

SUMMARY OF THE INVENTION

In accordance with the present invention there is provided a novel post construction and assembly of post and rails. Because of the materials used in the tube, the coating can be fabricated in various colors. Additionally, designs can be made with lettering embossed, stamped or painted that will play a useful function in connection with the fence. Examples of this would be "private property" and "no hunting".

A further object of the invention is to provide a fence that can be made from readily available materials of low cost. Fabrication can be completed on the spot or at a distant location. Because of the nature of the core of the post, it is possible to pass electrical conducting leads through the posts to electrify the fence. The post assembly itself is electrically nonconductive and it makes an excellent post for this type of fence.

BRIEF DESCRIPTION OF THE DRAWINGS

Reference is made to the drawings in which.

DETAILED DESCRIPTION OF THE PREFERRED EMBODIMENT

Figure 1:
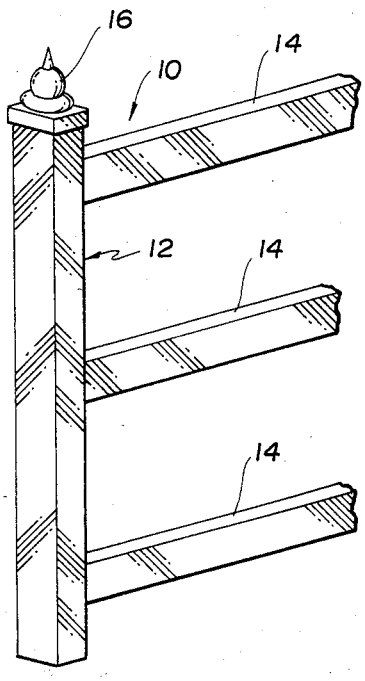
FIG. 1 is a fragmentary view in perspective showing a fencing assembly incorporating the present invention.

With reference to FIG. 1, there is shown a fencing assembly 10 including post 12 and rails 14. The rails 14 are preferably fitted into side channels 13 or openings pre-cut in the post 12. Alternately, fasteners such as screws or nails could be used to connect the rails and posts together. An ornamental cap 16 is shown that can be fitted to the top of the post 12.

Figure 2:
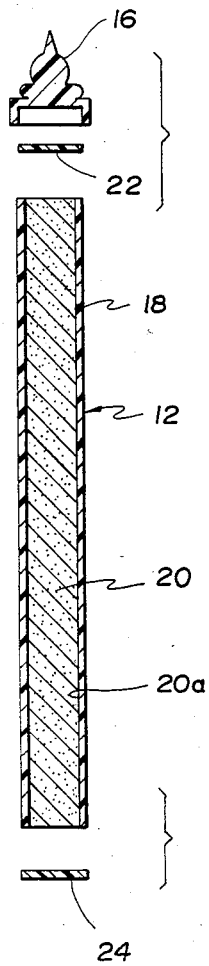
FIG. 2 is a spread sectional view showing a fence post in accordance with the invention.

FIG. 2 shows the construction of the post 12 which includes an external tube 18, preferably and extruded plastic tube fabricated from polyvinyl chloride, polyethylene or a similar plastic material. The core of the post 12 is indicated by the numeral 20. The core material is of a particulate matter such as sawdust, woodchips, or even common trash. A binder **20*a* is included in the core 20 which holds the particles together and to the inner surface of the tube 18 to form a solid core after hardening. Because of the parts used in the post, it is possible to ship the tubes 18 to the site of construction and at that point fill them with the available sawdust or other waste wood products thus cutting down the weight of parts to be shipped. Also shown in FIG. 2 are upper and lower caps 22, 24, respectively, which are used to seal tightly the ends of the fence post 12. Also shown is the ornamental cap 16 that may be press fit to the upper end of the post 12**.

It will be understood that the rails 14 are constructed similarly to the post 12 and include an extruded plastic tube and a light core material 20 and binder as described above for the fence post 12.

It will further be understood that pigment materials can be added to the extruded plastic at the time the post 18 is fabricated to give the desired color to the fence post. In a like manner, a color can be chosen and applied to the rails 14.

Figure 3:
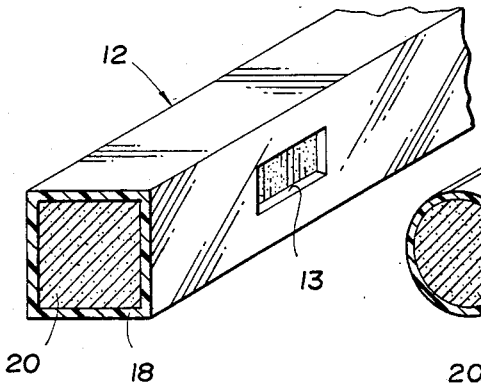
FIGS. 3 and 4 show different cross-sectioned configurations of post and rail possible with the present invention. In the several views provided, it will be understood that like reference numerals are used to indicate similar structural elements.
Figure 4:
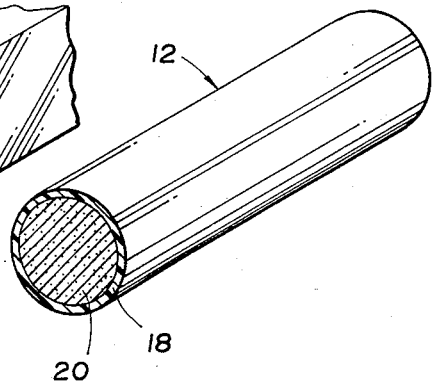

It is possible to form the posts 12 and the rails 14 from a variety of cross-sectional shapes either square as shown in FIG. 3 or round as shown in FIG. 4.

It will thus be seen that we have provided by our invention as improved construction of fencing assembly. We have further provided an improved process by which these articles can be fabricated and erected on the spot as described above.

We claim:

1. A fence post for use at a remote construction site;
- a tube of plastic material;
- a filler therein of particulate waste material comprising a waste wood product;
- a binder therein mixed with said filler at said site for adhering its particles together and to the tube inner surface; and
- a pair of flat sealing caps mounted on the upper and lower end of said tubes and contiguous with the outer profile of the tube.

2. The combination as set forth in claim 1 in which said plastic material comprises polyvinyl chloride.

3. The combination as set forth in claim 1 in which said plastic material comprises polyethylene.

* * * * *